US010016888B2

(12) United States Patent
Liu

(10) Patent No.: US 10,016,888 B2
(45) Date of Patent: Jul. 10, 2018

(54) WRENCH WITH DRIVER IN STORAGE

(71) Applicant: Chao-Chih Liu, Taichung (TW)

(72) Inventor: Chao-Chih Liu, Taichung (TW)

( * ) Notice: Subject to any disclaimer, the term of this patent is extended or adjusted under 35 U.S.C. 154(b) by 290 days.

(21) Appl. No.: 14/923,846

(22) Filed: Oct. 27, 2015

(65) Prior Publication Data

US 2016/0236341 A1 Aug. 18, 2016

(30) Foreign Application Priority Data

Feb. 13, 2015 (TW) ..... 104202557 U

(51) Int. Cl.
*B25G 1/08* (2006.01)
*B25B 13/46* (2006.01)
*B25B 13/56* (2006.01)

(52) U.S. Cl.
CPC ..... *B25G 1/085* (2013.01); *B25B 13/462* (2013.01); *B25B 13/56* (2013.01)

(58) Field of Classification Search
CPC ..... B25B 13/56; B25B 13/462; B25G 1/085; B25G 1/04; B25G 1/043; B25F 1/02; B25F 1/04
See application file for complete search history.

(56) References Cited

U.S. PATENT DOCUMENTS 6,401,301 B1 * 6/2002 Hung ..... B25B 15/04 16/430
6,431,034 B1 * 8/2002 Chen ..... B25B 13/461 81/124.4
6,640,675 B1 * 11/2003 Chuang ..... B25B 15/02 7/167
7,380,660 B2 * 6/2008 Lin ..... B25G 1/085 206/375
8,037,577 B2 * 10/2011 Chen ..... B25G 1/085 16/111.1
9,364,947 B2 * 6/2016 Wang ..... B25G 1/043
9,724,817 B2 * 8/2017 Hongquan ..... B25G 1/066
2003/0230175 A1 * 12/2003 Benatz ..... B25G 1/085 81/177.4
2008/0083304 A1 * 4/2008 Finn ..... B25B 13/461 81/177.4
2008/0295657 A1 * 12/2008 Cluthe ..... B25G 1/085 81/490
2011/0126678 A1 * 6/2011 Hu ..... B25B 13/463 81/63.1
2011/0226098 A1 * 9/2011 Zhang ..... B25B 15/02 81/177.4

* cited by examiner

*Primary Examiner* — David B Thomas
(74) *Attorney, Agent, or Firm* — Muncy, Geissler, Olds & Lowe, P.C.

(57) ABSTRACT

A wrench with driver in storage includes an operating section having one end thereof provided with a head for movably receiving a driver and the other end thereof provided with a combining part; a connecting section removably combined to the combining part; a handle having a containing space for storing the driver mounted around the connecting section with an end part of the handle mounted around the combining part; and a movable cover, disposed on the handle for sealing the containing space. The driver is stored in the handle of the wrench, facilitating the convenience of usage.

22 Claims, 8 Drawing Sheets

WRENCH WITH DRIVER IN STORAGE

BACKGROUND OF THE INVENTION

1. Field of the Invention

The present invention relates to wrenches, and more particularly, to a wrench with switchable drivers in storage.

2. Description of the Related Art

Regarding traditional driver-switchable ratchet wrench, the driver is removably combined to the head of the ratchet wrench, such that drivers with different sizes are chosen to be applied thereon for driving different screw members.

However, traditional ratchet wrench is not provided with a structure or space for storing different drivers, so that an additional tool box is needed to store the drivers. Also, the user is unable to immediately access the drivers with different sizes during operation. As a result, traditional ratchet wrench fails to meet the convenience demand.

Furthermore, most of the handle of traditional ratchet wrenches is made by injection molding, such that the handle and the wrench body are combined. The cost of manufacturing remains high; the competitiveness of the product is weakened.

SUMMARY OF THE INVENTION

For improving aforementioned issues, a wrench with driver in storage is disclosed, wherein the handle has a containing space for storing the switchable driver which is hidden under a movable cover, such that the driver is portable with the wrench, facilitating the convenience of usage.

For achieving the objectives above, a wrench with driver in storage is provided, comprising:

an operating section, having one end thereof provided with a head for movably receiving a driver and the other end thereof provided with a combining part;

a connecting section, removably combined to the combining part;

a handle, mounted around the connecting section, with an end part of the handle mounted around the combining part, the handle provided with a containing space for storing at least one driver; and a movable cover, disposed on the handle for sealing the containing space. With such configuration, at least a switchable driver is stored in the handle of the wrench, facilitating the convenience of usage.

For achieving the objectives above, another wrench with driver in storage is provided, comprising:

an operating section, having one end thereof provided with a head for movably receiving a driver and the other end thereof provided with a combining part, with the driver provided with a polygonal outer wall;

a connecting section, combined to the combining part;

a handle, having a first shell and a second shell covering two sides of the connecting section, respectively, such that the handle is provided with a containing space for storing at least one driver, wherein the containing space opens outward from the first shell, and an inner edge of the second shell is provided with a second engaging part;

a movable cover, pivotally disposed on the first shell for sealing the containing space, provided with a first engaging part engaging the driver together with the second engaging part, so as to prevent the driver from moving in the containing space; and a switch, disposed on the first shell for controlling the movable cover to open and close against the containing space.

With such configuration, the operating section, the connecting section, and the handle are respectively manufactured, instead of being integrally formed, achieving the advantages of simplifying producing process and lowering the manufacturing cost. Also, the first shell and the second shell are both provided with engaging parts, so as to stably position the driver in the containing space and prevent the driver from swaying and displacing.

DETAILED DESCRIPTION OF THE INVENTION

The aforementioned and further advantages and features of the present invention will be understood by reference to the description of the preferred embodiment in conjunction with the accompanying drawings where the components are illustrated based on a proportion for explanation but not subject to the actual component proportion.

Figure 1:
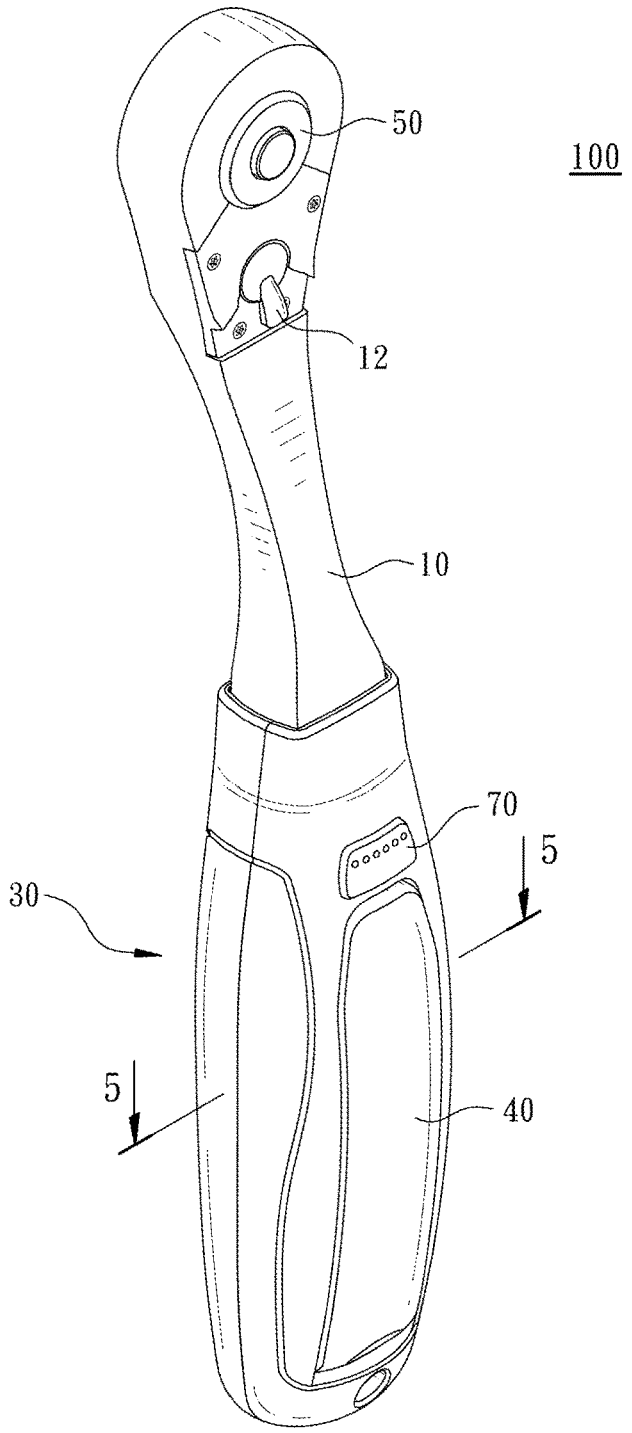
FIG. 1 is a perspective view of the wrench in accordance with the present invention.
Figure 2:
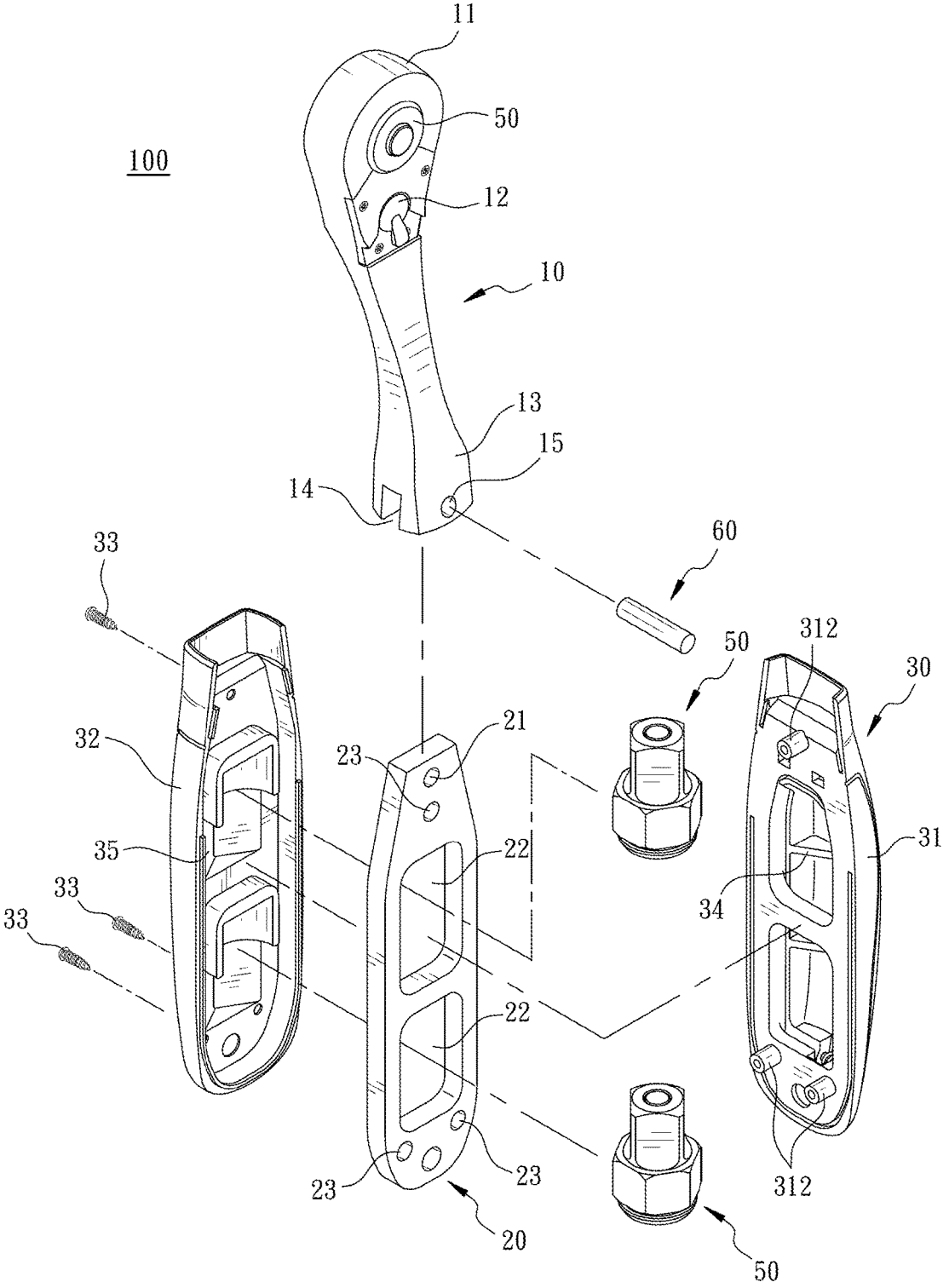
FIG. 2 is an exploded view of the wrench in accordance with the present invention.
Figure 3:
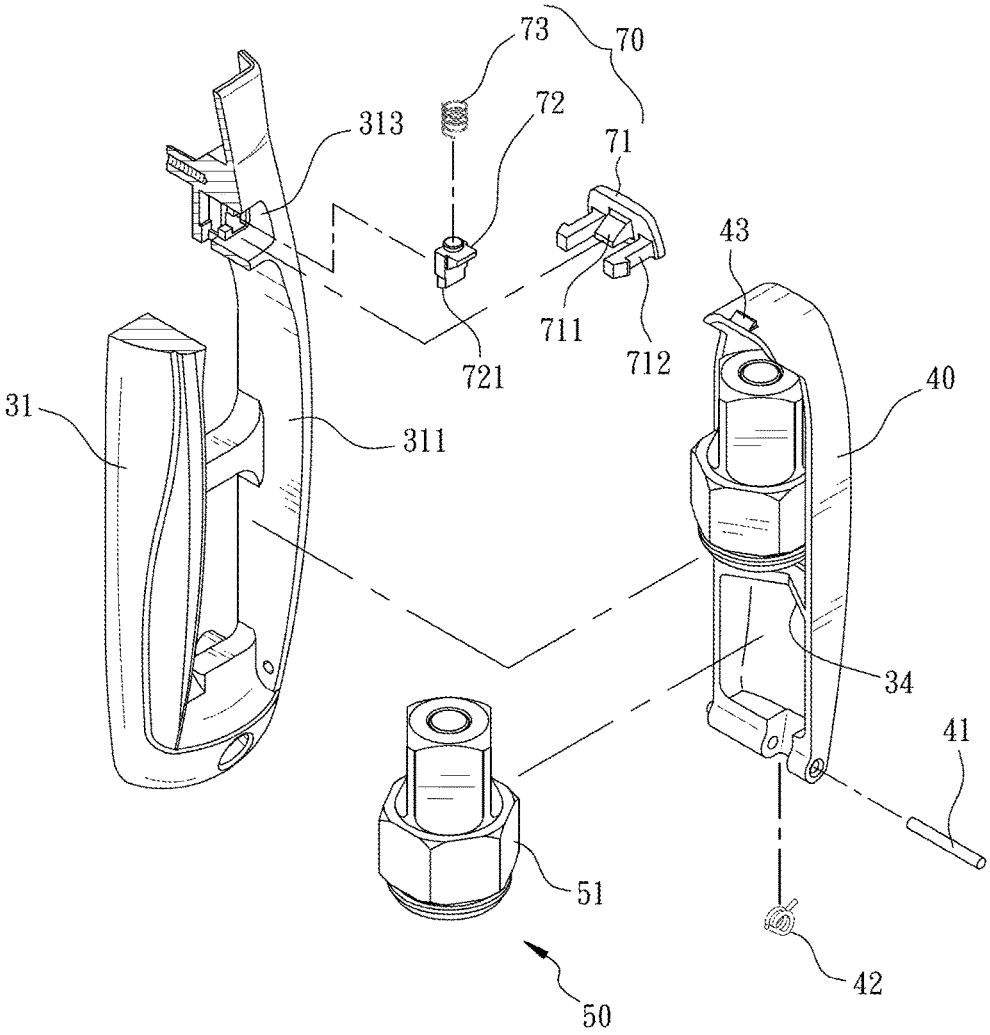
FIG. 3 is partially exploded view of the first shell and the movable cover.

Referring to FIG. 1 to FIG. 3, the wrench 100 with driver in storage comprises an operating section 10, a connecting section 20, a handle 30, and a movable cover 40.

The operating section 10 has one end provided with a head 11 for movably receiving a driver 50. The driver 50 has a polygonal outer wall 51. The operating section 10 further has a direction switching device 12 disposed in the head 11 for engaging the driver 50, whereby the driver 50 is allowed to drive a screw clockwise or counterclockwise. Furthermore, the other end of the operating section 10 has a combining part 13. A concave groove 14 is disposed on the edge of the combining part 13. Also, the combining part 13 is transversely provided with a pin bore 15 which passes through two sides of the concave groove 14.

The connecting section 20 is formed in a flat shape, with a combining bore 21 provided on one end thereof, such that a positioning pin 60 passes through the pin bore 15 of the combining part 13 and the combining bore 21, whereby the connecting section 20 is combined to one end of the operating section 10. For achieving a stable combination between the connecting section 20 and the operating section 10, the operating section 10 and the connecting section 20 are allowed to be welded after being combined to each other, so as to provide a greater torque during the operation of the wrench.

Also, the connecting section 20 has at least a through groove 22. In the preferred embodiment, two through grooves 22 are provided and formed in a rectangular shape. The through groove 22 allows the driver 50 to pass through freely. Two ends of the connecting section 20 are provided with plural positioning bores 23, respectively.

Figure 4:
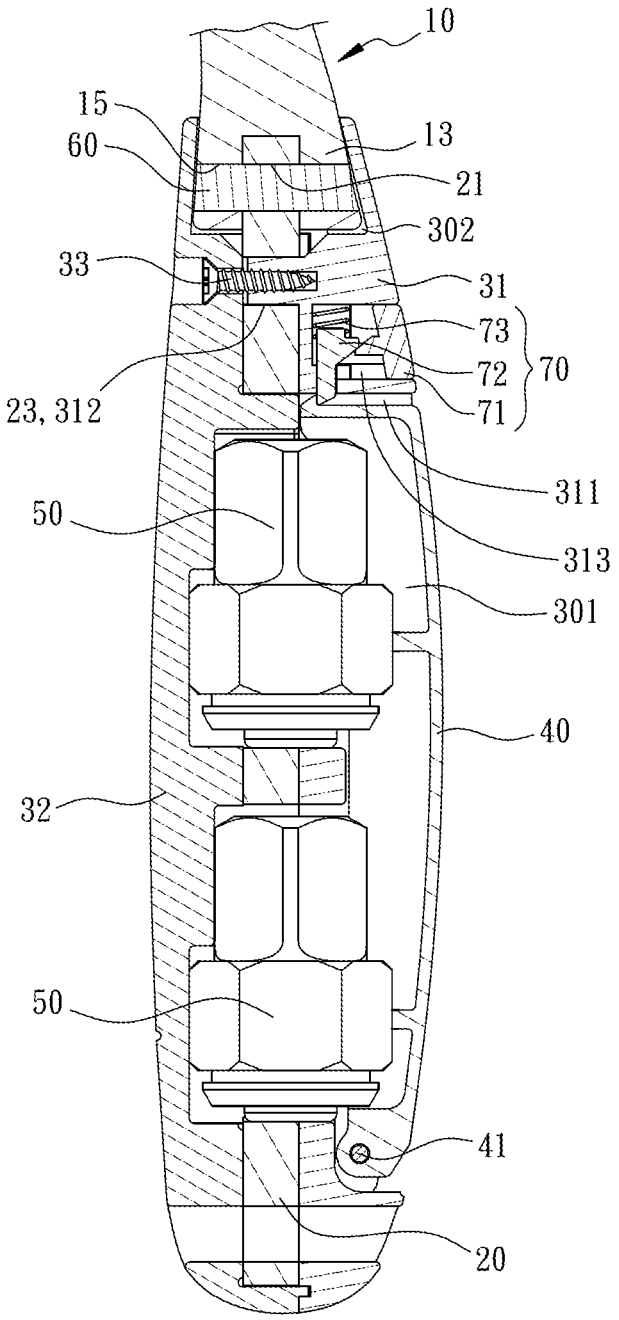
FIG. 4 is a sectional view of the handle in accordance with the present invention.

The handle 30 is mounted around the connecting section 20. Referring to FIG. 2 and FIG. 4, the handle 30 is formed of a first shell 31 and a second shell 32 covering the two sides of the connecting section 20 by use of screw, so as to provide a containing space 301 in the handle 30. The containing space 301 opens outward from the first shell 31, so as to store the driver 50 therein. A driver 50 installed on the head 11 and the driver 50 stored in the handle 30 are of different sizes, facilitating different operational demand. The first shell 31 and the second shell 32 form a sleeve recess 302 on one end of the handle 30 for being mounted around and cover the combining part 13, thus preventing the positioning pin 60 from being exposed.

Outer side of the first shell 31 is provided with a cover groove 311 connected with the containing space 301. The cover groove 311 receives and at the same time is sealed by the movable cover 40. Preferably, the movable cover 40 is pivotally disposed on the first shell 31 by use of a pin member 41 which passes through a torque spring 42, whereby the movable cover 40 is optionally kept open against the containing space 301. Also, inner side of the first shell 31 is provided with plural positioning pillars 312. Each positioning pillar 312 has a thread bore therein and passes through the corresponding positioning bore 23 of the connecting section 20, wherein screw member 33 is screwed on the positioning pillar 312 through the second shell 32, such that the first shell 31 and the second shell 32 are fixed on two sides of the connecting section 20. Through the combination between the positioning pillars 312 and the positioning bores 23, the handle 30 is stably mounted around the connecting section 20 and prevented from swaying against the connecting section 20.

Further, the first shell 31 has a switch recess 313 disposed on the side adjacent to the cover groove 311, wherein the switch recess 313 is connected with the cover groove 311, so as to enable a switch 70 to be disposed therein. The switch 70 is formed of a pressing member 71 and an engaging member 72. The engaging member 72 is transversely contained in the switch recess 313, and the pressing member 71 is pressingly disposed in the switch recess 313 for pushing the engaging member 72 to optionally engage the an engaging hook 43 on one end of the movable cover 40, whereby the movable cover 40 covers or open the cover groove 311. Preferably, the pressing member 71 and the engaging member 72 are provided with a pushing bevel 711 and a corresponding pushing bevel 721. When the pressing member 71 is pressed by an external force, the engaging member 72 is pushed away from the cover groove 311, so as to release the engaging hook 43 of the movable cover 40. In addition, the switch recess 313 is further provided with a spring member 73 for pushing the engaging member 72, so that the engaging member 72 is permanently pushed toward the cover groove 311 and inserted into the cover groove 311. Therefore, the switch 70 controls the movable cover 40 to open or close against the containing space 301.

Also, the pressing member 71 further has two hook portions 712 resiliently opening and closing against each other, whereby the pressing member 71 is disposed in the switch recess 313 and prevented from detaching therefrom.

Figure 5:
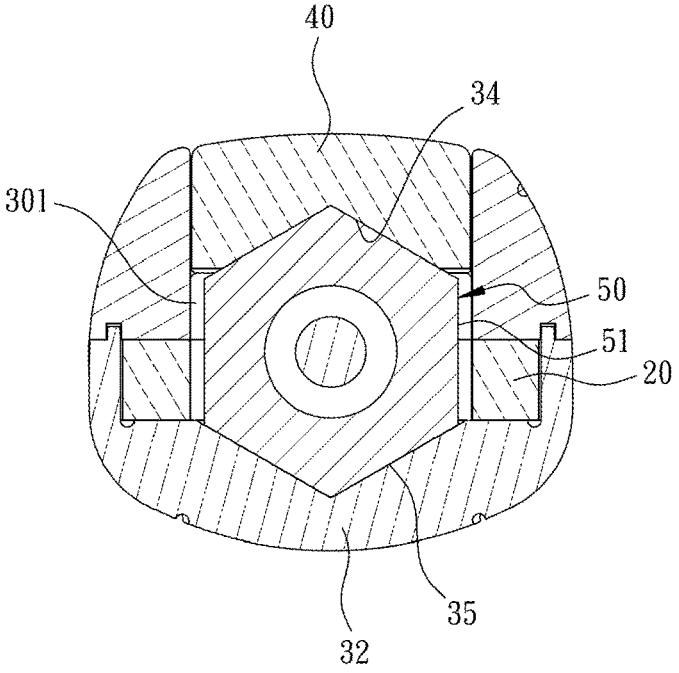
FIG. 5 is a cross-sectional view taking along 5-5 in FIG. 1 illustrating the engaging status of the driver.

For assuring that the driver 50 stored in the containing space 301 of the handle 30 does not sway, as shown in FIG. 5, the inner edge of the movable cover 40 is provided with a first engaging part 34, and the inner edge of the second shell 32 is provided with a second engaging part 35, wherein the first engaging part 34 and the second engaging part 35 are oppositely disposed and formed in a V shape, so as to engage the outer wall 51 of the driver 50 and prevent the driver 50 from moving in the containing space 301.

Figure 6:
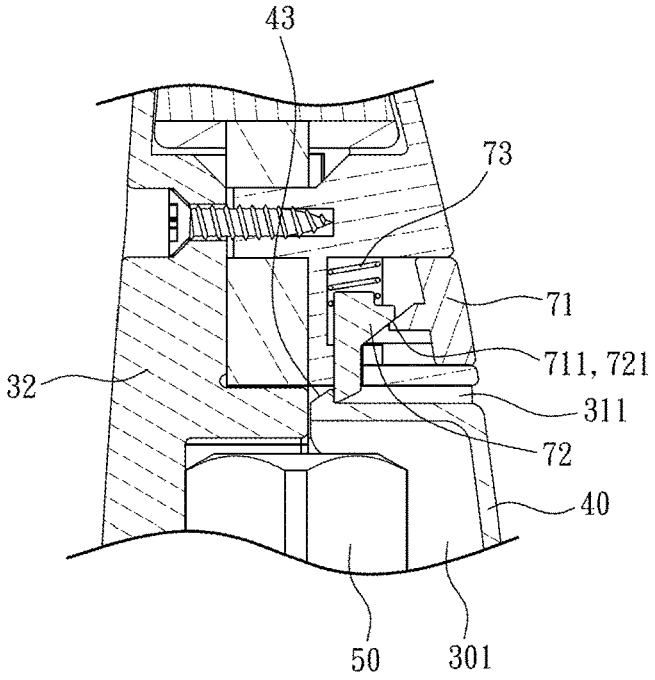
FIG. 6 is a partially enlarged view of FIG. 4 illustrating the movable cover closing against the containing space.

Referring to FIG. 4 and FIG. 6, when the movable cover 40 covers the cover groove 311, the engaging hook 43 of the movable cover 40 is engaged by the engaging member 72 of the switch 70, entering a positioned status, whereby the movable cover 40 seals the containing space 301. Thus, the driver 50 is stored in the containing space 301, so that the user is able to carry different drivers 50 simultaneously to facilitate screw driving operation.

Figure 7:
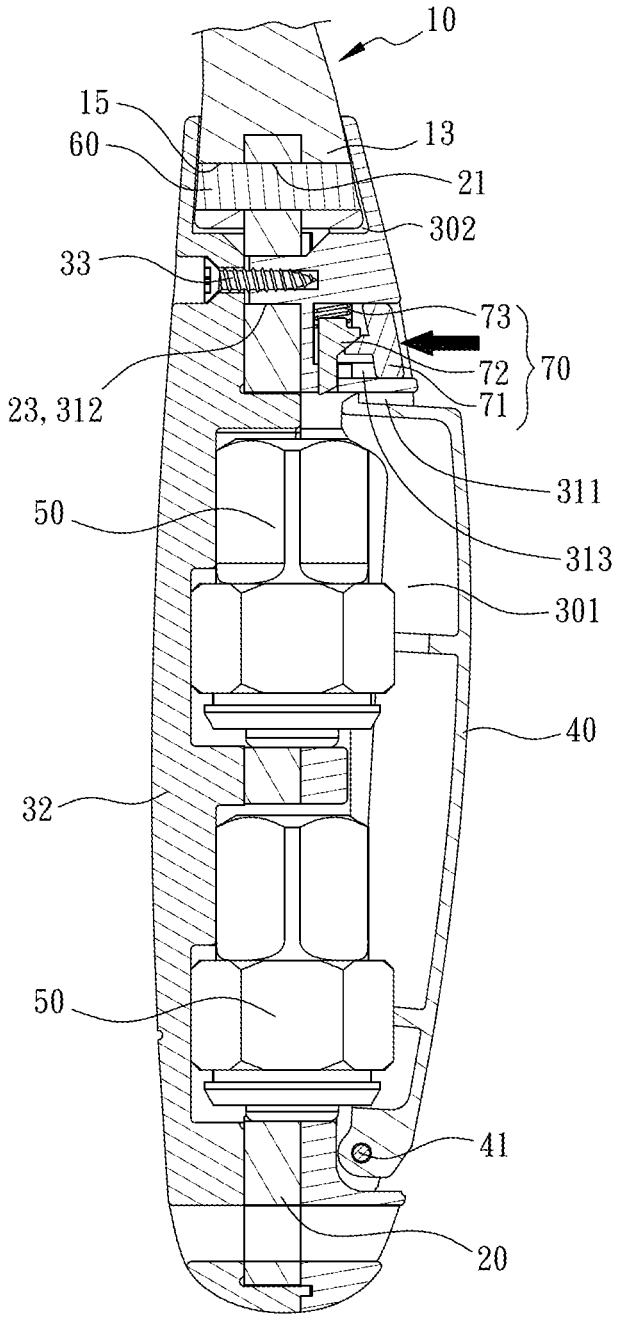
FIG. 7 is a sectional view of the handle illustrating the switch being pressed by external force.
Figure 8:
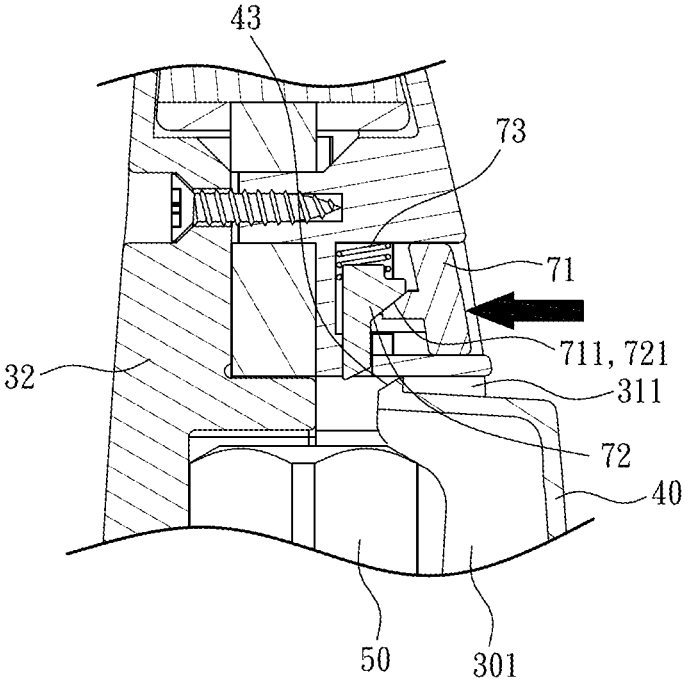
FIG. 8 is a partially enlarged view of FIG. 7 illustrating the movable cover opening against the containing space.
Figure 9:
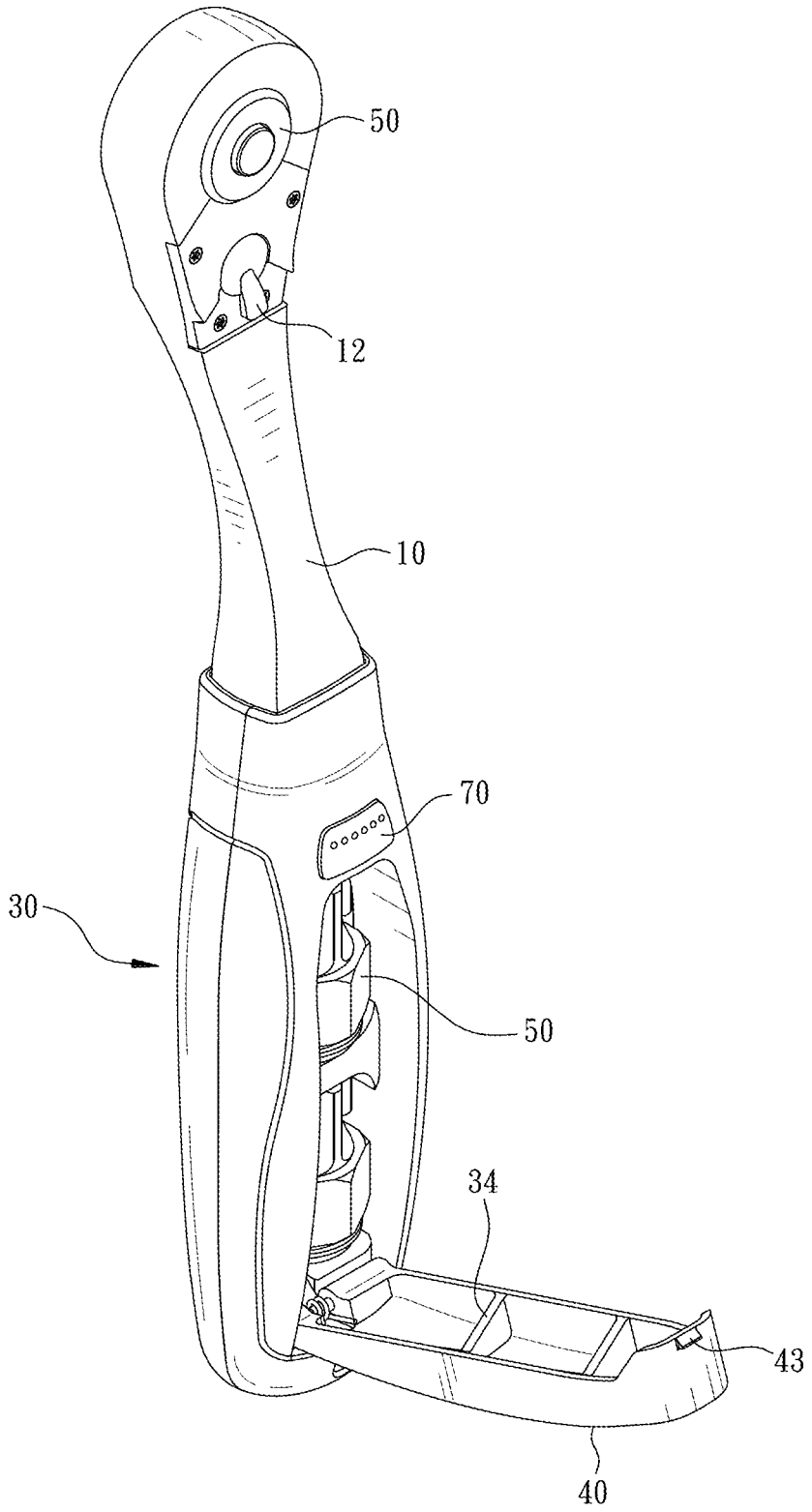
FIG. 9 is a perspective view illustrating the movable cover opening.

Referring to FIG. 7, FIG. 8, and FIG. 9, when the driver 50 is to be taken out from the movable cover 40, the user uses a finger to press the pressing member 71 of the switch 70, so as to push the engaging member 72 away from the cover groove 311, such that the engaging member 72 no longer engages the movable cover 40, whereby the movable cover 40 automatically pivots outward from the first shell 31. As a result, the containing space 301 is open, and the user is able to take out the switchable driver 50 for substituting another driver 50 originally installed on the wrench 100, facilitating the convenience of usage.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A wrench with driver in storage, comprising:

an operating section, having one end thereof provided with a head for movably receiving a driver and the other end thereof provided with a combining part, the combining part including a concave groove;

a connecting section, having one end thereof removably combined with the concave of the combining part;

a handle, mounted around the connecting section, with an end part of the handle mounted around the combining part, the handle provided with a containing space for storing the driver; and a movable cover, disposed on the handle for sealing the containing space.

2. The wrench of claim 1, further comprising a positioning pin passing through the combining part and the connecting section.

3. The wrench of claim 1, wherein the handle comprises a first shell and a second shell covering two sides of the connecting section, respectively, the containing space opens outward from the first shell, and the movable cover is disposed on the first shell.

4. The wrench of claim 3, wherein the first shell and the second shell form a sleeve recess on one end for being mounted around the combining part.

5. The wrench of claim 3, wherein the first shell and the second shell are screwedly combined to each other.

6. The wrench of claim 3, wherein the connecting section has plural positioning bores, and an inner side of the first shell has plural positioning pillars corresponding to the positioning bores.

7. The wrench of claim 3, wherein an inner edge of the second shell is provided with a second engaging part, and the movable cover has a first engaging part, such that the first and second engaging parts engage the driver to prevent the driver from moving in the containing space.

8. The wrench of claim 7, wherein the driver has a polygonal outer wall, and the first and second engaging parts are formed in a V shape.

9. The wrench of claim 1, wherein the connecting section has at least a through groove for the driver to pass therethrough freely.

10. The wrench of claim 1, further comprising a switch disposed on the handle for controlling the movable cover to open and close against the containing space.

11. The wrench of claim 1, wherein one end of the movable cover is pivotally disposed on the handle and permanently opens against the containing space.

12. A wrench with driver in storage, comprising:

an operating section, having one end thereof provided with a head for movably receiving a driver and the other end thereof provided with a combining part, with the driver provided with a polygonal outer wall;

a connecting section, combined to the combining part;

a handle, having a first shell and a second shell covering two sides of the connecting section, respectively, such that the handle is provided with a containing space for storing the driver, wherein the containing space opens outward from the first shell, and an inner edge of the second shell is provided with a second engaging part;

a movable cover, pivotally disposed on the first shell for sealing the containing space, and provided with a first engaging part, such that the first engaging part and the second engaging part engage the driver together, so as to prevent the driver from moving in the containing space; and a switch, disposed on the first shell for controlling the movable cover to open and close against the containing space.

13. The wrench of claim 12, further comprising a positioning pin passing through the combining part and the connecting section.

14. The wrench of claim 13, wherein the combining part has a concave groove for receiving an end part of the connecting section.

15. The wrench of claim 12, wherein the first shell and the second shell form a sleeve recess on one end for being mounted around the combining part.

16. The wrench of claim 12, wherein the first shell and the second shell are screwedly combined to each other.

17. The wrench of claim 12, wherein the connecting section has plural positioning bores, and an inner side of the first shell has plural positioning pillars corresponding to the positioning bores.

18. The wrench of claim 12, wherein the connecting section has at least a through groove for the driver to pass therethrough freely.

19. The wrench of claim 12, wherein the first shell has a switch recess for the switch to be disposed in the switch recess; the switch is formed of a pressing member and an engaging member, the engaging member transversely disposed in the switch recess, and the pressing member pressingly disposed in the switch recess for pushing the engaging member in order to optionally engage the movable cover.

20. The wrench of claim 19, wherein the first shell has a cover groove for receiving the movable cover, and the switch recess is provided with a spring member therein for pushing the engaging member, such that the engaging member permanently moves toward the cover groove and is inserted into the cover groove.

21. The wrench of claim 19, wherein a pushing bevel and another corresponding pushing bevel are disposed on the pressing member and the engaging member, respectively.

22. The wrench of claim 12, wherein the movable cover is pivotally disposed on the first shell by use of a pin member which passing through a torque spring, whereby the movable cover is kept open against the containing space.

* * * * *